US009149078B1

(12) United States Patent
Curtin

(10) Patent No.: US 9,149,078 B1
(45) Date of Patent: Oct. 6, 2015

(54) ARM SOCKS/ARM SWEATER/SCARF SYSTEMS

(71) Applicant: April Curtin, Anaheim, CA (US)

(72) Inventor: April Curtin, Anaheim, CA (US)

( * ) Notice: Subject to any disclaimer, the term of this patent is extended or adjusted under 35 U.S.C. 154(b) by 0 days.

(21) Appl. No.: 14/556,018

(22) Filed: Nov. 28, 2014

Related U.S. Application Data

(60) Provisional application No. 61/916,642, filed on Dec. 16, 2013.

(51) Int. Cl.
*A42B 5/00* (2006.01)
*A41D 23/00* (2006.01)
*A41D 1/00* (2006.01)

(52) U.S. Cl.
CPC . *A41D 23/00* (2013.01); *A41D 1/00* (2013.01)

(58) Field of Classification Search
CPC ... A41D 13/0015; A41D 13/08; A41D 27/16; A41D 27/10; A41D 23/00
USPC ..... 2/69, 16, 59, 60, 126, 207; 602/62, 63
See application file for complete search history.

(56) References Cited

U.S. PATENT DOCUMENTS 1,285,917 A * 11/1918 Bradley et al. ..... 2/91
2,099,431 A * 11/1937 Reeb ..... 2/126
4,559,647 A 12/1985 Smith et al.
4,706,304 A 11/1987 Jones
5,182,812 A * 2/1993 Goldsby ..... 2/79
5,642,525 A * 7/1997 Ketola ..... 2/16
5,774,892 A * 7/1998 Tisdale et al. ..... 2/69
6,047,404 A * 4/2000 Blanks, I ..... 2/69
6,158,056 A * 12/2000 Riley ..... 2/269
6,665,876 B1 * 12/2003 Newman ..... 2/59
6,880,172 B2 * 4/2005 Quintero ..... 2/16
7,578,004 B2 * 8/2009 Loyens et al. ..... 2/16
2012/0204318 A1 8/2012 Dark

* cited by examiner

*Primary Examiner* — Tejash Patel
(74) *Attorney, Agent, or Firm* — RG Patent Consulting, LLC; Rachel Gilboy

(57) ABSTRACT

A tubular garment sheath system includes a first tubular garment sheath assembly having a first stretchable top piece, a first stretchable bottom piece, a first first end having at least one first pocket, and a first second end having at least one male fastener; and a first interior volume; and a second tubular garment sheath assembly having a second stretchable top piece, a second stretchable bottom piece, a second first end having at least one second pocket, a second second end having at least one female fastener; and a second interior volume. The tubular garment sheath system is structured and arranged to keep the first arm and the second arm warm during sudden temperature changes by shielding the first arm and the second arm from cold temperatures while preventing body heat from escaping from the first arm and said second arm.

19 Claims, 5 Drawing Sheets

ARM SOCKS/ARM SWEATER/SCARF SYSTEMS

CROSS-REFERENCE TO RELATED APPLICATION

The present application is related to and claims priority from prior provisional application Ser. No. 61/916,642, filed Dec. 16, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of cold weather apparel for warmth and protection from colder temperatures and more specifically relates to a tubular garment sheath system.

2. Description of the Related Art

Clothing is fiber and textile material worn on the body. The wearing of clothing is mostly restricted to human beings and is a feature of nearly all human societies. The amount and type of clothing worn depends on physical, social and geographic considerations, including sex.

Physically, clothing serves many purposes: it can serve as protection from the elements, and can enhance safety during hazardous activities such as hiking and cooking. It protects the wearer from rough surfaces, rash-causing plants, insect bites, splinters, thorns and prickles by providing a barrier between the skin and the environment. Clothes can insulate against cold or hot conditions. Further, they can provide a hygienic barrier, keeping infectious and toxic materials away from the body. Clothing also provides protection from harmful UV radiation.

A scarf, also known as a neck-wrap is a piece of fabric worn around the neck, or near the head or around the waist for warmth, cleanliness, fashion or for religious reasons. They can come in a variety of different colors but are often singular in purpose.

Various attempts have been made to solve problems found in cold weather apparel for warmth and protection from colder temperatures art. Among these are found in: U.S. Pat. No. 4,706,304 to David J. Jones; U.S. Pat. No. 4,559,647 to Rae Smith et al.; U.S. Publication No. 2012/0204318 to James Martin Dark. This prior art is representative of convertible accessory garments with multi-purpose uses for arm-coverage, warmth and comfort, and fashionable neckwear. None of the above inventions and patents, taken either singly or in combination, is seen to describe the invention as claimed.

Ideally, a tubular garment sheath system should be user-friendly and safe in-use and, yet may operate reliably and be manufactured at a modest expense. Thus, a need exists for a tubular garment sheath system which is structured and arranged to keep a first arm and a second arm warm during sudden temperature changes by shielding the first arm and the second arm from cold temperatures while preventing body heat from escaping from the first arm and the second arm and to avoid the above-mentioned problems.

BRIEF SUMMARY OF THE INVENTION

In view of the foregoing disadvantages inherent in the known cold weather apparel for warmth and protection from colder temperatures device art, the present invention provides a tubular garment sheath system (entitled Arm Socks/Arm Sweater/Scarf Systems) The general purpose of the present invention, which will be described subsequently in greater detail is to provide a tubular garment sheath system which is structured and arranged to keep a first arm and a second arm warm during sudden temperature changes by shielding the first arm and the second arm from cold temperatures while preventing body heat from escaping from the first arm and the second arm.

A tubular garment sheath system is disclosed herein in a preferred embodiment comprising: a first tubular garment sheath assembly having a first stretchable top piece, a first stretchable bottom piece, a first first end having at least one first pocket, and a first second end having at least one male fastener; and a first interior volume; and a second tubular garment sheath assembly having a second stretchable top piece, a second stretchable bottom piece, a second first end having at least one second pocket, a second second end having at least one female fastener; and a second interior volume. The tubular garment sheath system comprises the first tubular garment sheath assembly and the second tubular garment sheath assembly. The tubular garment sheath system is structured and arranged to keep the first arm and the second arm warm during sudden temperature changes by shielding the first arm and the second arm from cold temperatures while preventing body heat from escaping from the first arm and the second arm.

The first stretchable top piece, the first stretchable bottom piece, the first first end, the first second end having the at least one male fastener; and the first interior volume comprises the first tubular garment sheath assembly. The first stretchable top piece and the first stretchable bottom piece are fastenable together thereby forming the first interior volume. The first tubular garment sheath assembly comprises a blend of cotton, spandex, polyester, angora, and nylon. The first tubular garment sheath assembly is reusable and machine washable and dryable. The first tubular garment sheath assembly is slid over a first arm, specifically a first forearm to a first elbow joint acting as a fitted sheath when in an in-use condition. The first tubular garment sheath assembly is approximately 15 to 17 inches in length and approximately 3 to 4 inches in width dimensioned for fitting over the first arm of the user wearer.

The first first end on first tubular garment sheath assembly comprises approximately a first 2-inch perimeter of deformable elastic material to prevent unwanted displacement of the first tubular garment sheath assembly when in the in-use condition. The at least one first pocket having at least one first fastener located directly below the first 2-inch perimeter of deformable elastic material for safely securing personal items including money, loose change, credit and debit cards, and identification cards including driver's licenses and student IDs. The first fastener comprises a first zippable fastener.

The second stretchable top piece, the second stretchable bottom piece, the second first end, the second second end having the at least one female fastener; and the second interior volume comprises the second tubular garment sheath assembly. The second stretchable top piece and the second stretchable bottom piece are fastenable together thereby forming the second interior volume. The second tubular garment sheath assembly comprises a blend of cotton, spandex, polyester, angora, and nylon. The second tubular garment sheath assembly is reusable and machine washable and dryable. The second tubular garment sheath assembly is slid over a second arm, specifically a second forearm to a second elbow joint acting as a fitted sheath when in the in-use condition.

The second tubular garment sheath assembly is approximately 15 to 17 inches in length and approximately 3 to 4 inches in width dimensioned for fitting over the second arm of the user wearer. The second first end on the second tubular garment sheath assembly comprises approximately a second 2-inch of deformable elastic material to prevent unwanted displacement of the first tubular garment sheath assembly when in the in-use condition. The at least one second pocket having at least one second fastener located directly below the first 2-inch perimeter of deformable elastic material for safely securing personal items including money, loose change, credit and debit cards, and Identification cards including driver's licenses and student IDs. The second fastener preferably comprises a zippable fastener.

The at least one male fastener on the first tubular garment sheath assembly is removably-coupleable to the second least one female fastener on the second tubular garment sheath assembly and is structured and arranged to act as a scarf and is wrapped around a neck of a user-wearer when the first tubular garment sheath and the second tubular garment sheath are not removably-attached to the first arm and the second arm respectively. The at least one male fastener(s) and at least one female fastener(s) comprises exactly two male fastener(s) and female fastener(s) for providing additional securement when removably-coupling together the first tubular garment sheath assembly and second first tubular garment sheath assembly to one-another.

The male fastener comprises a male snap. The female fastener comprises a female snap. The first second tubular garment sheath assembly further comprises a third male snap located on the first first end while the second tubular garment sheath assembly further comprises a third female snap located on the second first end for permitting the user-wearer to cross the first second tubular garment sheath assembly and the first second tubular garment sheath assembly in a criss-cross fashion when the third male snap and third female snap are removably-coupled together.

A kit is also embodied herein for the tubular garment sheath system comprising a plurality of first tubular garment sheath assemblies in various colors, designs and sizes, a plurality of mated second tubular garment sheath assemblies in matching colors, designs, and sizes; and a set of user-instructions.

A method of using a tubular garment sheath system is also disclosed herein comprising the steps of: choosing a first tubular garment sheath assembly having at least one male snap in a user-preferred color, design and size dimensioned to fit over a first arm; choosing a second tubular garment sheath assembly having at least one female snap in a user-preferred color, design and size dimensioned to fit over a second arm; inserting a first arm into the first tubular garment sheath assembly to protect the first arm from cold temperatures; inserting the second arm into the second tubular garment sheath assembly to protect the second arm from cold temperatures; removing the first tubular garment sheath assembly from the first arm when no longer needed for future use; removing the second tubular garment sheath assembly from the second arm when no longer needed for future use; fastening together via the male snap and the female snap the first tubular garment sheath assembly and the second tubular garment sheath assembly thereby form a scarf; placing the scarf around a neck of a user-wearer; and removing the scarf for storage and future use.

The present invention holds significant improvements and serves as a tubular garment sheath system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention to tubular garment sheath system (entitled Arm Socks/Arm Sweater/Scarf Systems) constructed and operative according to the teachings of the present invention.

DETAILED DESCRIPTION

Figure 1A:
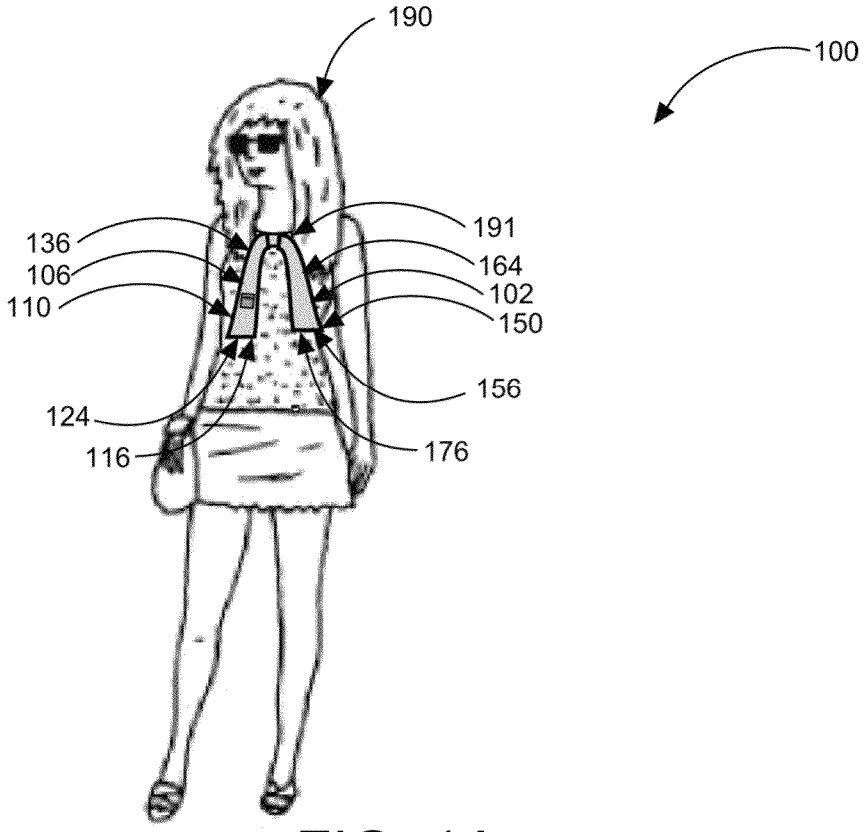
FIG. 1A shows a perspective view illustrating a tubular garment sheath system in an 'in-use' condition according to an embodiment of the present invention.

As discussed above, embodiments of the present invention relate to a cold weather apparel item for warmth and protection from colder temperatures device (entitled Arm Socks/Arm Sweater/Scarf Systems) which is structured and arranged to keep a first arm and a second arm warm during sudden temperature changes by shielding the first arm and the second arm from cold temperatures while preventing body heat from escaping from the first arm and the second arm.

Generally speaking Arm Socks/Arm Sweater/Scarf System preferably comprises a specially designed line of soft, comfortable sheathes that are specially designed to encompass the arms only. In this manner, consumers may possess a simple and effective means of staving off sudden chills, without the need to constantly carry around a bulky sweater or jacket.

The Arm Socks-Arm Sweater/Scarf System preferably is offered in pairs, or in two (2) elongated, tubular units that, as the name implies, resemble "socks for the arms." Fabricated of durable yet gentle materials that could comprise a blend of cotton, spandex, polyester, angora, and/or nylon, each Arm Sock preferably comprises dimensions of approximately fifteen to seventeen inches (15"-17") in length and three to four inches (3"-4") in width. For a secure fit on the arms, the distal end of the units preferably include a two inch (2") perimeter of stretchy spandex; additionally, snap buttons may be provided to secure the unit around the neck as one piece, when it is employed as a scarf, and also a 2nd snap, so that the bottom of the scarf may be connected in a crossing fashion. Just below the stretchy spandex, is preferably a small zippered pocket able to hold loose change, one's I.D., or credit cards.

The Arm Socks-Arm Sweater/Scarf System may be made available in smaller sizes to accommodate children, as well as in a line of eye-catching, fashionable colors and materials to appeal to individual tastes. Machine washable, the Arm Socks may be tossed in a washer and dryer when laundering is needed. The Arm Socks-Arm Sweater/Scarf System may provide consumers with a more user friendly accessory for keeping warm during sudden temperature changes.

Compact, form fitting garments that can be slid over the arms, this practical product preferably eliminates the need to keep a sweater or jacket tied around the waist or carried in the hand should one need to stave off a chill. In addition, the construction of the system may effectively shield the arms from cold, yet not present a cumbersome garment.

Multifunctional, the Arm Socks-Arm Sweater/Scarf System may simply be secured around the neck when it is not cool enough for arm coverage. Offered in a wide variety of colors and styles, there is sure to be an Arm Socks set to perfectly compliment any ensemble. In addition, when worn, the Arm Sock may simply appear as a second shirt worn underneath one's primary top. While the Arm Socks/Arm Sweater/Scarf is designed for use by men, women, and children, the product may prove especially ideal to females who may be experiencing the symptoms of menopause, as their body temperatures can continuously fluctuate.

The Arm Socks-Arm Sweater/Scarf System is an innovative product invention which may effectively alleviate the challenges already faced when dressing to protect the body from sudden changes in temperatures. Offered in a variety of lengths and widths, and featuring a practical pocket, this versatile product may be enjoyed by children as well as adults.

Figure 1B:
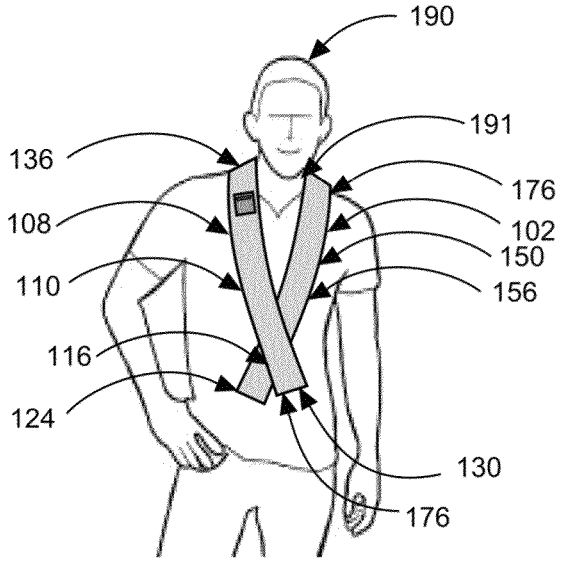
FIG. 1B shows a perspective view illustrating a tubular garment sheath system in another 'in-use' condition according to an embodiment of the present invention.
Figure 2:
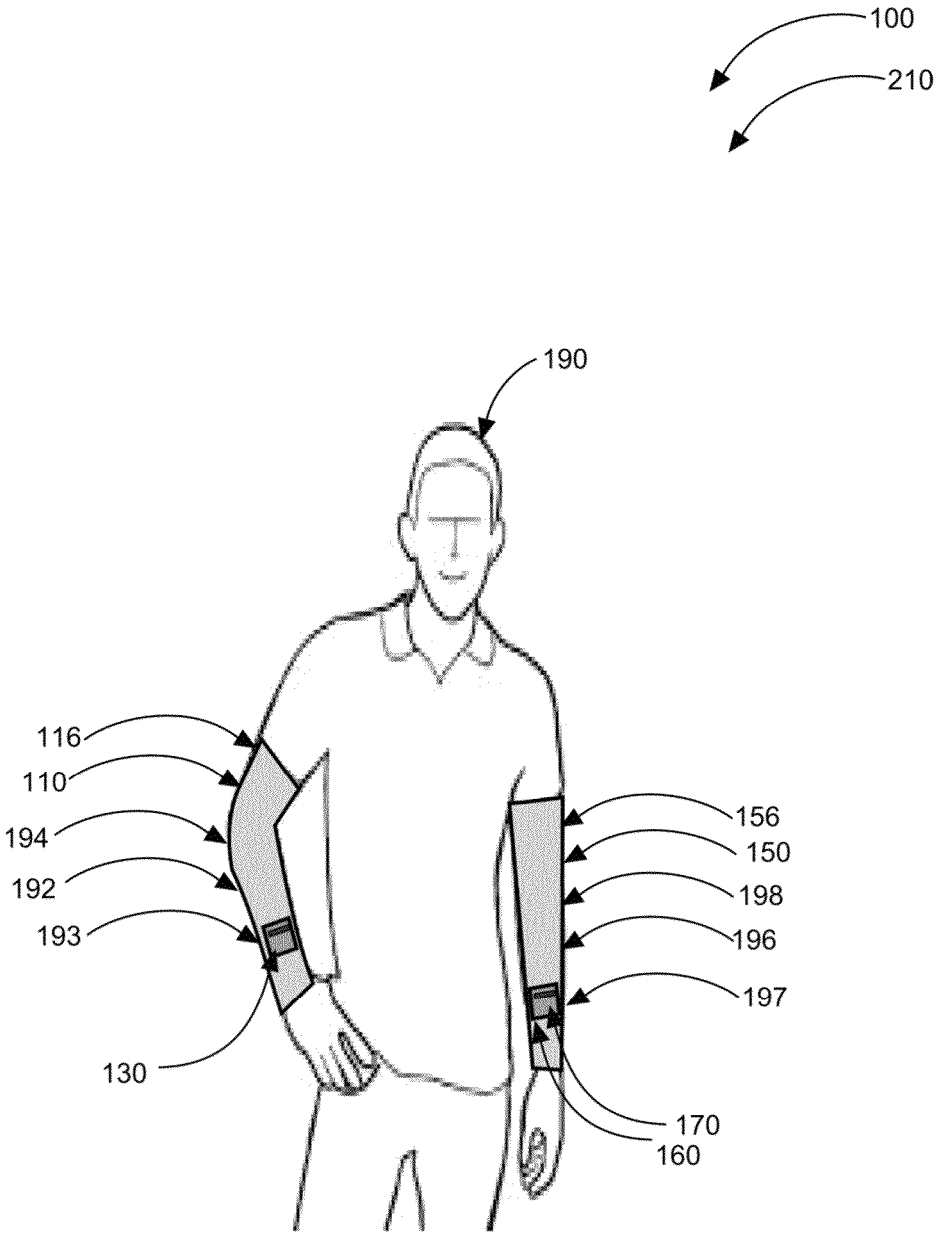
FIG. 2 shows a perspective view illustrating a first tubular garment sheath assembly removably-coupled around a first arm of a user-wearer and a second tubular garment sheath assembly removably-coupled around a second arm of the user-wearer of the tubular garment sheath system according to an embodiment of the present invention.
Figure 3:
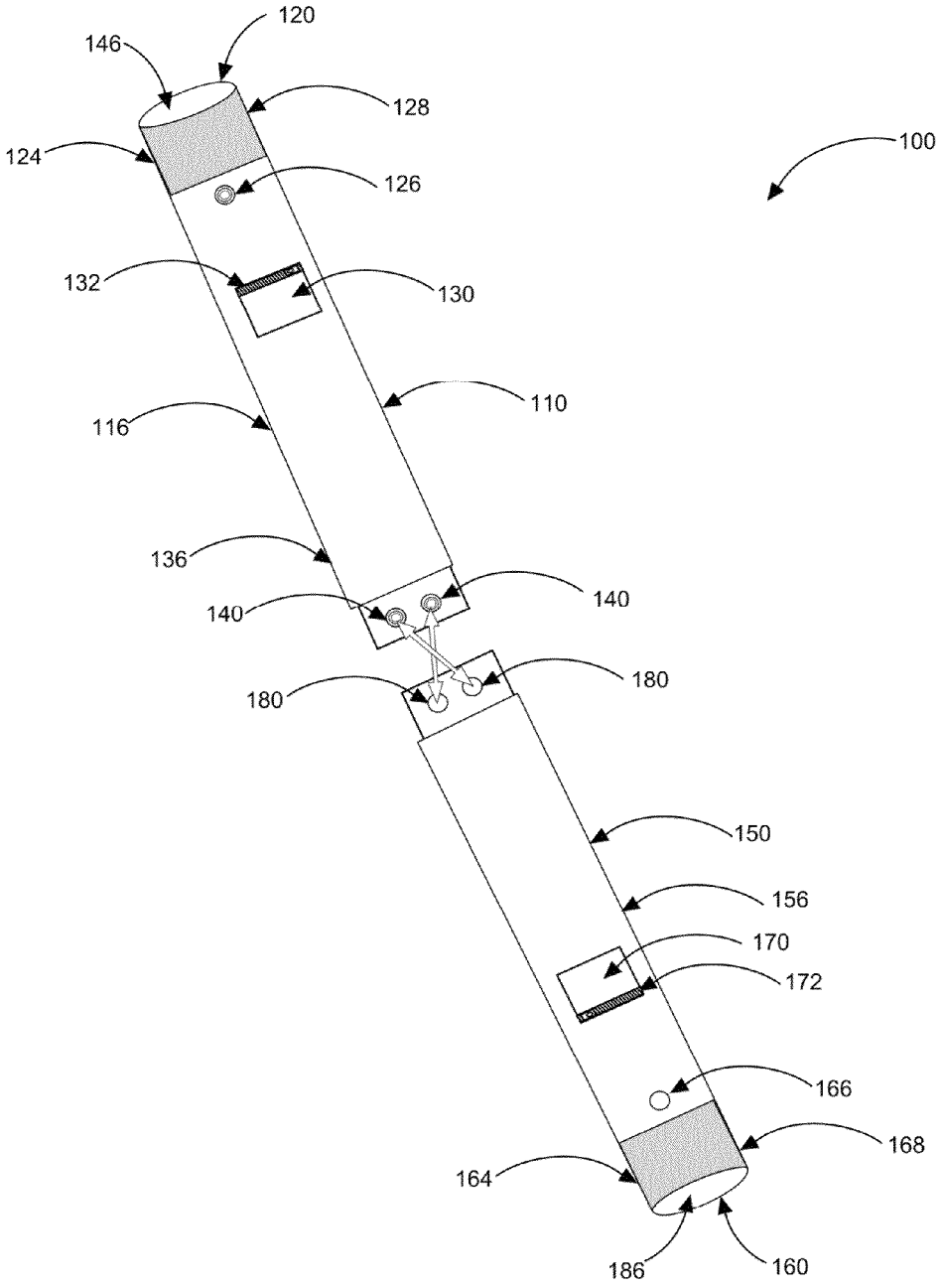
FIG. 3 is a perspective view illustrating a first tubular garment sheath assembly removably-coupled around a first arm of a user-wearer and a second tubular garment sheath assembly removably-coupled around a second arm of the user-wearer of the tubular garment sheath system according to an embodiment of the present invention.

Referring now to the drawings by numerals of reference there is shown in FIGS. 1-3 perspective views illustrating first tubular garment sheath assembly 110 removably-coupled around first arm 192 of user-wearer 190 and second tubular garment sheath assembly 150 removably-coupled around second arm 196 of the user-wearer 190 of tubular garment sheath system 100 according to an embodiment of the present invention as shown best in FIG. 2.

Tubular garment sheath system 100 comprises: first tubular garment sheath assembly 110 having first stretchable top piece 116, first stretchable bottom piece 120, first first end 124 having an optional at least one first pocket 130, and first second end 136 having at least one male fastener 140; and first interior volume 146; and second tubular garment sheath assembly 150 having second stretchable top piece 156, second stretchable bottom piece 160, second first end 164 having at least one second pocket 170, second second end 176 having at least one female fastener 180; and second interior volume 186. Tubular garment sheath system 100 comprises first tubular garment sheath assembly 110 and second tubular garment sheath assembly 150. Tubular garment sheath system 100 is structured and arranged to keep first arm 192 and second arm 196 warm during sudden temperature changes by shielding first arm 192 and second arm 196 from cold temperatures while preventing body heat from escaping from first arm 192 and second arm 196 as shown in FIG. 2.

First stretchable top piece 116, first stretchable bottom piece 120, first first end 124, first second end 136 having at least one male fastener 140; and first interior volume 146 comprises first tubular garment sheath assembly 110. First stretchable top piece 116 and first stretchable bottom piece 120 are fastenable together thereby forming first interior volume 146. First tubular garment sheath assembly 110 comprises a blend of cotton, spandex, polyester, angora, and nylon. First tubular garment sheath assembly 110 is reusable and machine washable and dryable. First tubular garment sheath assembly 110 is slid over first arm 192, specifically first forearm 193 to first elbow joint 194 acting as a fitted sheath when in in-use condition 106. First tubular garment sheath assembly 110 is approximately 15 to 17 inches in length and approximately 3 to 4 inches in width dimensioned for fitting over first arm 192 of user-wearer 190.

First first end 124 on first tubular garment sheath assembly 110 comprises approximately first 2-inch perimeter of deformable elastic material 128 to prevent unwanted displacement of first tubular garment sheath assembly 110 when in in-use condition 106. At least one first pocket 130 having at least one first fastener 132 located directly below first 2-inch perimeter of deformable elastic material 126 for safely securing personal items including money, loose change, credit and debit cards, and identification cards including driver's licenses and student IDs. First fastener 110 comprises a first zippable fastener. Upon reading this specification, it should be appreciated that, under appropriate circumstances, considering such issues as user preferences, design preference, structural requirements, marketing preferences, cost, available materials, technological advances, etc., other fastener arrangements such as, for example, hook and loop fastener system, snaps, buttons, etc., may be sufficient.

Second stretchable top piece 156, second stretchable bottom piece 160, second first end 164, second second end 176 having at least one female fastener 180; and second interior volume 186 comprises second tubular garment sheath assembly 150. Second stretchable top piece 156 and second stretchable bottom piece 160 are fastenable together thereby forming second interior volume 186. Second tubular garment sheath assembly 150 comprises a blend of cotton, spandex, polyester, angora, and nylon. Second tubular garment sheath assembly 150 is reusable and machine washable and dryable. Second tubular garment sheath assembly 150 is slid over second arm 196, specifically second forearm 197 to second elbow joint 198 acting as a fitted sheath when in in-use condition 106.

Second tubular garment sheath assembly 150 is approximately 15 to 17 inches in length and approximately 3 to 4 inches in width dimensioned for fitting over second arm 196 of user wearer 190 in preferred embodiments. Second first end 164 on second tubular garment sheath assembly 150 comprises approximately second 2-inch of deformable elastic material 168 to prevent unwanted displacement of second tubular garment sheath assembly 150 when in in-use condition 106. At least one second pocket 170 having at least one second fastener 172 located directly below first 2-inch perimeter of deformable elastic material 166 for safely securing personal items including money, loose change, credit and debit cards, and Identification cards including driver's licenses and student IDs. Second fastener 172 comprises a zippable fastener. Upon reading this specification, it should be appreciated that, under appropriate circumstances, considering such issues as user preferences, design preference, structural requirements, marketing preferences, cost, available materials, technological advances, etc., other fastener arrangements such as, for example, a hook and loop fastener system, snaps, buttons, etc., may be sufficient.

At least one male fastener 140 on first tubular garment sheath assembly 110 is removably-coupleable to at least one female fastener 110 on second tubular garment sheath assembly 150 and is structured and arranged to act as scarf 102 and is wrapped around neck 191 of user-wearer 190 when first tubular garment sheath assembly 110 and second tubular garment sheath assembly 150 are not removably-attached to first arm 192 and second arm 196 respectively as shown in first in-use condition 106 of FIG. 1A. At least one male fastener(s) 140 and at least one female fastener(s) 180 comprises exactly two male fastener(s) 140 and female fastener(s) 180 for providing additional securement when removably-coupling together first tubular garment sheath assembly 110 and second first tubular garment sheath assembly 150 to one-another.

Male fastener 140 comprises a male snap. Female fastener 180 comprises a female snap. First second tubular garment sheath assembly 110 further comprises third male snap 126 located on first first end 124 while second tubular garment sheath assembly 150 further comprises third female snap 166 located on second first end 164 for permitting user-wearer 190 to cross first tubular garment sheath assembly 110 and second tubular garment sheath assembly 150 in a criss-cross fashion when third male snap 126 and third female snap 166 are removably-coupled together as shown in second in-use condition 108 of FIG. 1B.

Figure 4:
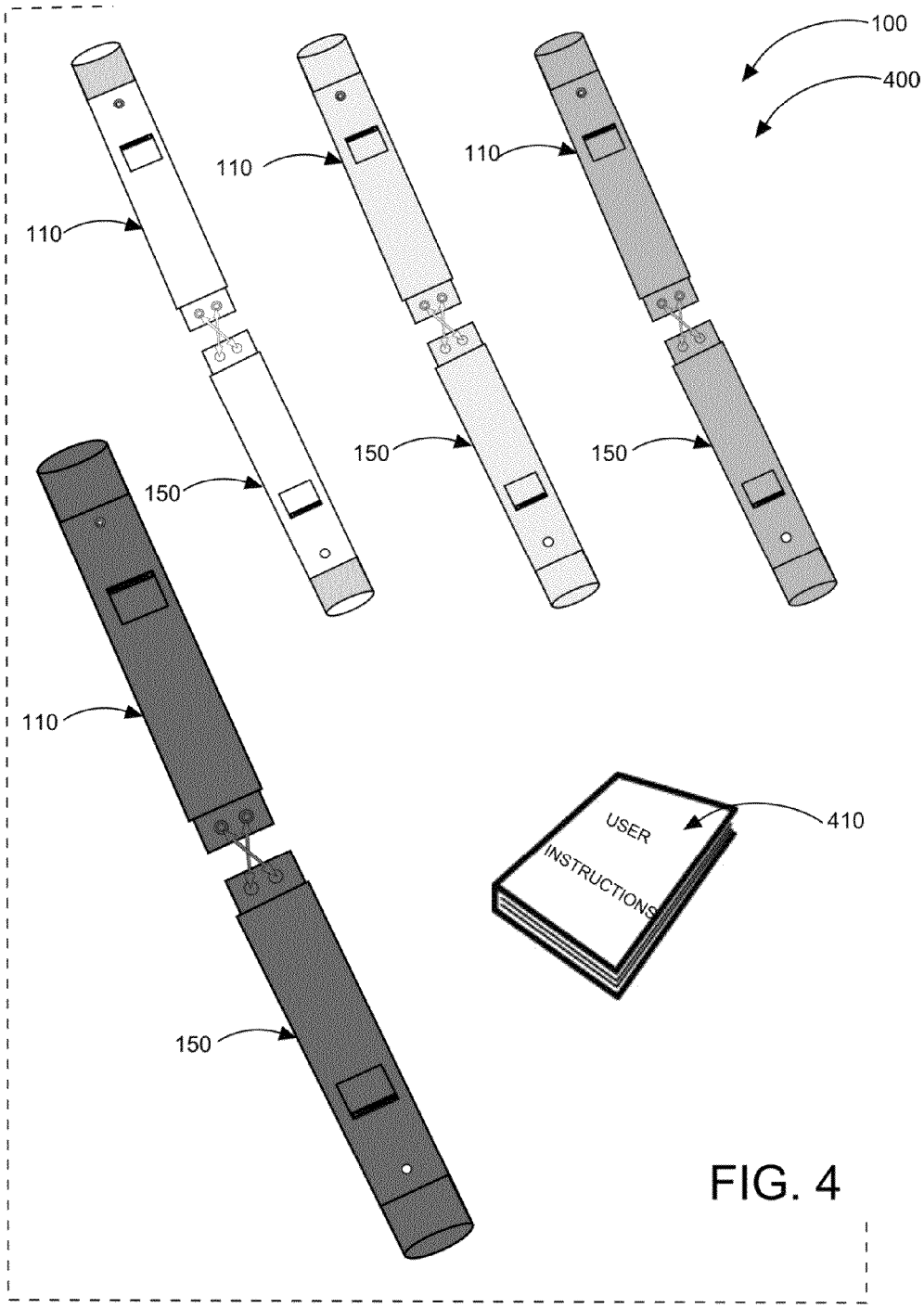
FIG. 4 is a perspective view illustrating a kit of the tubular garment sheath system according to an embodiment of the present invention.

Referring now to FIG. 4 showing a perspective view illustrating kit 400 of tubular garment sheath system 100 according to an embodiment of the present invention of FIG. 1.

Kit 400 is embodied herein for tubular garment sheath system 100 comprising plurality of first tubular garment sheath assemblies 110 in various colors, designs and sizes, a plurality of mated second tubular garment sheath assemblies 150 in matching colors, designs, and sizes; and set of user-instructions 410. Tubular garment sheath system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color/design combinations, parts may be sold separately, etc., may be sufficient.

Figure 5:
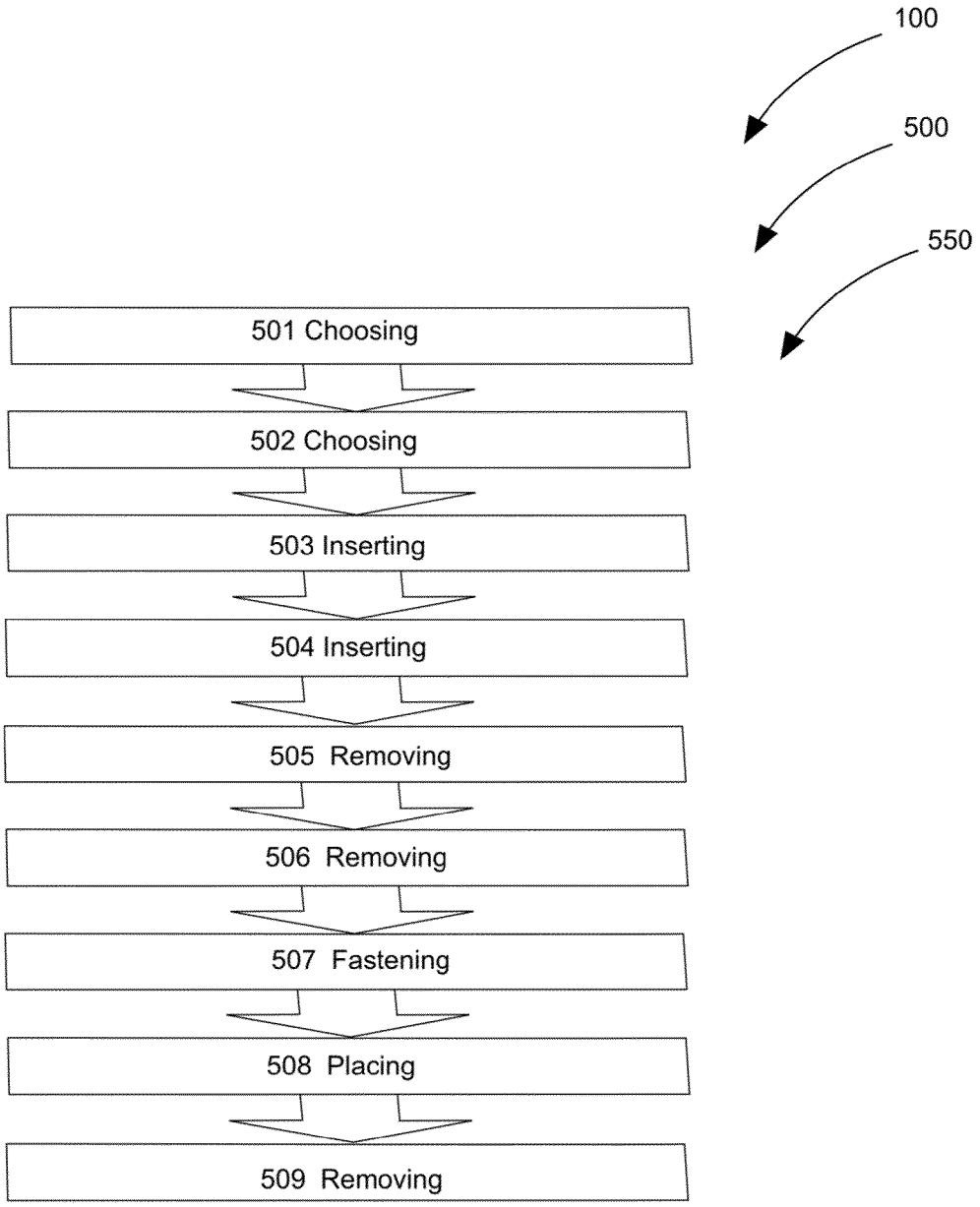
FIG. 5 is a flowchart illustrating a method of use for the tubular garment sheath system according to an embodiment of the present invention of FIGS. 1-4.

Referring now to FIG. 5, flowchart 550 illustrating method of use 500 for tubular garment sheath system is 100 according to an embodiment of the present invention of FIGS. 1-4.

Method of using tubular garment sheath system 100 comprises the steps of: step one 501 choosing first tubular garment sheath assembly 110 having at least one male snap (at least one male fastener 140) in a user-preferred color, design and size dimensioned to fit over first arm 192; step two 502 choosing second tubular garment sheath assembly 150 having at least one female snap (at least one female fastener 180) in a user-preferred color, design and size dimensioned to fit over second arm 196; step three 503 removing first tubular garment sheath assembly 110 from first arm 192 when no longer needed for future use; step three 504 removing second tubular garment sheath assembly 150 from second arm 196 when no longer needed for future use; step five 505 fastening together via male snap (at least one male fastener 140) and female snap (at least one female fastener 180) first tubular garment sheath assembly 110 and second tubular garment sheath assembly 150 thereby form scarf 102; step six 506 placing scarf 102 around neck 191 of user-wearer 190; and step seven 507 removing scarf 191 for storage and future use.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tubular garment sheath system comprising:

a first tubular garment sheath assembly having, a first tubular garment sheath stretchable top piece, a first tubular garment sheath stretchable bottom piece, a first tubular garment sheath first end, and a first tubular garment sheath second end having at least one male fastener; and a first tubular garment sheath interior volume;

a second tubular garment sheath assembly having, a second tubular garment sheath stretchable top piece, a second tubular garment sheath stretchable bottom piece, a second tubular garment sheath first end, a second tubular garment sheath second end having at least one female fastener; and a second tubular garment sheath interior volume;

wherein said tubular garment sheath system comprises said first tubular garment sheath assembly and said second tubular garment sheath assembly;

wherein said first tubular garment sheath stretchable top piece, said first tubular garment sheath stretchable bottom piece, said first tubular garment sheath first end, said first tubular garment sheath second end having said at least one male fastener; and said first tubular garment sheath interior volume comprises said first tubular garment sheath assembly;

wherein said first tubular garment sheath stretchable top piece and said first tubular garment sheath stretchable bottom piece are fastenable together thereby forming said first tubular garment sheath interior volume;

wherein said first tubular garment sheath assembly is slid over a first arm, specifically a first forearm to a first elbow joint acting as a fitted sheath when in an in-use condition;

wherein said second tubular garment sheath stretchable top piece, said second tubular garment sheath stretchable bottom piece, said second tubular garment sheath first end, said second tubular garment sheath second end having said at least one female fastener; and said second tubular garment sheath interior volume comprises said second tubular garment sheath assembly;

wherein said second tubular garment sheath stretchable top piece and said second tubular garment sheath stretchable bottom piece are fastenable together thereby forming said second tubular garment sheath interior volume;

wherein said second tubular garment sheath assembly is slid over a second arm, specifically a second forearm to a second elbow joint acting as a fitted sheath when in said in-use condition;

wherein said at least one male fastener on said first tubular garment sheath assembly is removably-coupleable to said second at least one female fastener on said second tubular garment sheath assembly and is structured and arranged to act as a scarf and is wrapped around a neck of a user-wearer when said first tubular garment sheath and said second tubular garment sheath are not removably-attached to said first arm and said second arm respectively; and wherein said tubular garment sheath system is structured and arranged to keep said first arm and said second arm warm during sudden temperature changes by shielding said first arm and said second arm from cold temperatures while preventing body heat from escaping from said first arm and said second arm.

2. The tubular garment sheath system of claim 1 wherein said first tubular garment sheath assembly comprises a blend of cotton, spandex, polyester, angora, and nylon.

3. The tubular garment sheath system of claim 2 wherein said first tubular garment sheath assembly is reusable and machine washable and dryable.

4. The tubular garment sheath system of claim 1 wherein said second tubular garment sheath assembly comprises a blend of cotton, spandex, polyester, angora, and nylon.

5. The tubular garment sheath system of claim 4 wherein said second tubular garment sheath assembly is reusable and machine washable and dryable.

6. The tubular garment sheath system of claim 1 wherein said first tubular garment sheath assembly is approximately 15 to 17 inches in length and approximately 3 to 4 inches in width dimensioned for fitting over said first arm of said user wearer.

7. The tubular garment sheath system of claim 1 wherein said second tubular garment sheath assembly is approximately 15 to 17 inches in length and approximately 3 to 4 inches in width dimensioned for fitting over said second arm of said user wearer.

8. The tubular garment sheath system of claim 1 wherein said first tubular garment sheath first end on said first tubular garment sheath assembly comprises approximately a first 2-inch perimeter of deformable elastic material to prevent unwanted displacement of said first tubular garment sheath assembly when in said in-use condition.

9. The tubular garment sheath system of claim 8 wherein said first tubular garment sheath assembly further comprises at least one first tubular garment sheath pocket having at least one first tubular garment sheath fastener located directly below said first 2-inch perimeter of deformable elastic material for safely securing personal items including money, loose change, credit and debit cards, and identification cards including driver's licenses and student IDs.

10. The tubular garment sheath system of claim 9 wherein said first tubular garment sheath fastener comprises a first tubular garment sheath zippable fastener.

11. The tubular garment sheath system of claim 1 wherein said second tubular garment sheath first end on said second tubular garment sheath assembly comprises approximately a second 2-inch of deformable elastic material to prevent unwanted displacement of said first tubular garment sheath assembly when in said in-use condition.

12. The tubular garment sheath system of claim 11 wherein said second tubular garment sheath assembly further comprises at least one second tubular garment sheath pocket having at least one second tubular garment sheath fastener located directly below said second 2-inch perimeter of deformable elastic material for safely securing personal items including money, loose change, credit and debit cards, and Identification cards including driver's licenses and student IDs.

13. The tubular garment sheath system of claim 11 wherein said second tubular garment sheath fastener comprises a second tubular garment sheath zippable fastener.

14. The tubular garment sheath system of claim 1 wherein said male fastener comprises a male snap.

15. The tubular garment sheath system of claim 1 wherein said female fastener comprises a female snap.

16. The tubular garment sheath system of claim 1 wherein said at least one male fastener(s) and at least one female fastener(s) comprises exactly two said male fastener(s) and said female fastener(s) for providing additional securement when removably-coupling together said first tubular garment sheath assembly and second first tubular garment sheath assembly to one-another.

17. The tubular garment sheath system of claim 1 wherein said first tubular garment sheath assembly further comprises a third male snap located on said first tubular garment sheath first end while said second tubular garment sheath assembly further comprises a third female snap located on said second tubular garment sheath first end for permitting said user-wearer to cross said first tubular garment sheath assembly and said second tubular garment sheath assembly in a criss-cross fashion when said third male snap and third female snap are removably-coupled together.

18. The tubular garment sheath system of claim 1 further comprising a kit including:

a plurality of said first tubular garment sheath assemblies in various colors, designs and sizes, a plurality of said mated second tubular garment sheath assemblies in matching colors, designs, and sizes; and a set of user-instructions.

19. A method of using a tubular garment sheath system comprising the steps of:

choosing a first tubular garment sheath assembly having at least one male snap in a user-preferred color, design and size dimensioned to fit over a first arm;

choosing a second tubular garment sheath assembly having at least one female snap in a user-preferred color, design and size dimensioned to fit over a second arm;

inserting said first arm into said first tubular garment sheath assembly to protect said first arm from cold temperatures;

inserting said second arm into said second tubular garment sheath assembly to protect said second arm from cold temperatures;

removing said first tubular garment sheath assembly from said first arm when no longer needed for future use;

removing said second tubular garment sheath assembly from said second arm when no longer needed for future use;

fastening together via said male snap and said female snap said first tubular garment sheath assembly and said second tubular garment sheath assembly thereby form a scarf;

placing said scarf around a neck of a user-wearer; and removing said scarf for storage and future use.

* * * * *